United States Patent [19]

Tanner

[11] Patent Number: 4,483,383

[45] Date of Patent: Nov. 20, 1984

[54] PROCESS FOR COMPACTING GRANULAR MATERIALS

[75] Inventor: Hans Tanner, Schaffhausen, Switzerland

[73] Assignee: George Fischer Ltd., Switzerland

[21] Appl. No.: 310,968

[22] Filed: Oct. 13, 1981

[30] Foreign Application Priority Data

Nov. 6, 1980 [CH] Switzerland ..... 8235/80

[51] Int. Cl.[3] ..... B22C 15/00

[52] U.S. Cl. ..... 164/37; 164/12

[58] Field of Search ..... 164/12, 37, 169

[56] References Cited

U.S. PATENT DOCUMENTS 3,170,202 4/1965 Huston, Sr. et al. .

4,306,609 12/1981 Fischer et al. ..... 164/37

FOREIGN PATENT DOCUMENTS 1182415 2/1970 United Kingdom .

1386093 3/1973 United Kingdom .

OTHER PUBLICATIONS

Publication from "Russian Castings Production", 1968, No. 4, pp. 155 and 156.

*Primary Examiner*—Nicholas P. Godici

*Assistant Examiner*—P. Weston Musselman, Jr.

*Attorney, Agent, or Firm*—Roylance, Abrams, Berdo & Goodman

[57] ABSTRACT

A method of compacting particulate material includes providing a primary fuel mixture of air and natural gas in a closed chamber enclosing a surface of the material to be compacted. An additive gas, such as hydrogen, having a higher combustion velocity is added to the primary fuel/air mix and ignited, creating an exothermic reaction which compacts the material. The additive gas increases the gradient of the pressure rise curve of the combustion. Various fuels and additive gases and disclosed.

7 Claims, No Drawings

PROCESS FOR COMPACTING GRANULAR MATERIALS

This invention relates to a process for packing or compacting granular materials, particularly foundry mold materials, employing an exothermic reaction in a closed chamber to which a surface of the material is exposed.

BACKGROUND OF THE INVENTION

As disclosed in U.S. Pat. No. 3,170,202, the concept of using an explosion process for the manufacturer of molds and cores for the foundry industry is broadly known. In that patent, it is suggested that the mold material can be packed by the explosion-like combustion of a fuel over the mold material in a closed system. However, the technique disclosed therein has the disadvantage that the results produced by the disclosed technique are not reproducible. Additionally, the ultimate force values necessary for foundry purposes cannot be attained with that system without the use of additional oxygen. Thus, the technique is, as a practical matter, not satisfactory.

BRIEF DESCRIPTION OF THE INVENTION

An object of the present invention is to provide a process which overcomes the disadvantages of the prior art and permits satisfactory manufacture of molds with predetermined, controlled packing values which are highly reproducible without the use of additional oxygen.

Additionally, an object of the present invention is to provide such a process in which the maximum packing pressure is relatively low.

Briefly described, the invention includes a process for the packing of granular materials, particularly foundry mold materials, by exothermic reaction in a closed chamber of a mixture of air and at least one primary fuel having a low combustion velocity wherein the exothermic reaction is initiated by the application of ignition energy comprising the steps of providing a closed chamber containing a predetermined volume of mixed air and the primary fuel wherein a surface of the material to be packed is exposed to the volume of mixed air and fuel, adding to the mixed air and primary fuel at least one gaseous additive fuel having a combustion velocity significantly greater than that of the primary fuel, and initiating the exothermic reaction.

The desired reproducible combustion process is attained with these features. With the process according to the invention, it is particularly advantageous that the maximum pressure attained after triggering of the combustion in the closed system is below 8 bars which remarkably lowers the stress on the apparatus.

In the performance of this process, a primary reaction mixture of air and natural gas is advantageous since this is a most economical mixture. However, other hydrocarbons mixed with the air can be used. The theoretical combustion velocity of a mixture of air and natural gas (methane) is approximately 35 centimeters per second. With the addition of hydrogen, of which the combustion velocity is approximately 260 centimeters per second, the pressure rise per unit time during the reaction is changed considerably. Thus, the mold hardness can essentially be determined by varying the added volume of hydrogen, or by using a mixture of air and hydrogen only.

Although hydrogen is most suitable as a gaseous additive fuel, others gases can be used such as stack gas or blast furnace gas (stack gas), generator gas (producer gas) gas or coal gas, which gases generally have a higher combustion velocity than a natural gas (or methane)-air mixture.

Following is an example of the process in accordance with the invention.

Natural gas is conducted under low pressure into a closed combustion chamber filled with atmospheric air, the chamber being constructed so that a major surface of the granular material to be compacted is exposed to the mixture of natural gas and air contained in the chamber. A selected quantity of hydrogen is delivered into the natural gas-air mixture in the chamber at low pressure, or is delivered into the chamber simultaneously with the natural gas. The entire mixing process is carried out at ambient temperature and pressure. The chamber is then closed and ignited, resulting in an explosion-like reaction which exerts sufficient force on the surface of the granular material to adequately compact it. In such a chamber having one cubic meter of air space, a typical quantity of natural gas is 8.2% by volume and 10.3% by volume of hydrogen is added.

The reaction mixture can consist of a combination of a plurality of fuels, and the exothermic reaction which results is initiated by ignition.

It has been shown that in addition to the variation of the fuel mixture, variation of the ignition energy or firing power is also important to obtain the desired degree of packing since a positive correlation exists both between the value of the aggregate ignition energy to the fuel mixture, and also to the pressure rise per unit time. Even with an ignition force of approximately 40 microjoules, ignition occurs with favorable fuel mixtures. Greater degrees of ignition energy can be used up to a limit value of approximately 10,000 joules. Greater forces than that yield no essential difference.

The ignition or detonation energy can be supplied in various ways. It is possible to use a spark discharge device, a capacitive discharge or inductive spark discharge, a flame, an incandescent wire, or a burning pyrophoric blasting material.

A further advantage of the invention is that, in addition to permitting the use of a much cheaper natural gas-air mixture, only small volumes of hydrogen are used in order to increase the combustion velocity and, therewith, to positively influence the sand packing. Also, good results are retained in the manufacture of foundry cores.

While certain advantageous embodiments have been chosen to illustrate the invention it will be understood by those skilled in the art that various changes and modifications can be made therein without departing from the scope of the invention as defined in the appended claims.

What is claimed is:

1. A process for compacting granular foundry mold material in a closed and sealed chamber, comprising the steps of:

adding a primary hydrocarbon fuel of natural gas and air into a closed combustion chamber over and exposed to a surface of the material being compacted;

adding and mixing with the primary fuel a gaseous additive fuel of hydrogen gas; and igniting the mixed fuels to initiate an exothermic reaction developing and exerting pressure on the material surface to compact the material.

2. A process according to claim 1 wherein ignition energy igniting the mixed fuels is regulated.

3. A process according to claim 1 wherein the mixed fuels are ignited by electric energy.

4. A process according to claim 1 wherein the mixed fuels are ignited by combustion of pyrophoric ignition material.

5. A process according to claim 1 wherein the mixed fuels are ignited by flame or an incandescent wire.

6. A process according to claim 1 wherein the mixed fuels are ignited by ignition energy supplied at a plurality of locations in the gaseous mixture of fuels.

7. A process according to claim 1 wherein the at least one additive fuel is combined with the air-primary fuel mixture at substantially ambient pressure and temperature.

* * * * *